United States Patent [19]

Rosenberg

[11] Patent Number: 4,843,522

[45] Date of Patent: Jun. 27, 1989

[54] VEHICULAR LAMP WITH MOVING LIGHT SOURCE

[76] Inventor: Burton A. Rosenberg, 1089 Hanley Ave., Los Angeles, Calif. 90049

[21] Appl. No.: 586,809

[22] Filed: Mar. 6, 1984

[51] Int. Cl.[4] ..... F21V 19/00

[52] U.S. Cl. ..... 362/61; 362/288

[58] Field of Search ..... 362/61, 276, 288, 277, 362/319, 390

[56] References Cited

U.S. PATENT DOCUMENTS 3,300,636 1/1967 Quelland et al. ..... 362/390

3,678,266 7/1972 Fradette ..... 362/390

FOREIGN PATENT DOCUMENTS 473540 10/1937 United Kingdom ..... 362/390

*Primary Examiner*—Andrew M. Dolinar

*Attorney, Agent, or Firm*—Charles H. Schwartz; Ellsworth R. Roston

[57] ABSTRACT

A vehicle lamp for mounting on a vehicle and for providing a moving and variable light intensity display, including a lamp body having a display area for visually displaying light energy produced within the lamp body by a source of light energy, a first structure for focusing the light energy produced by the light source at the display area, and a second structure for providing related movement between the source of light and the first structure for producing variations in the focusing of the light energy at the display area to provide a moving and variable light intensity at the display area. The source of light may be a light bulb or a filament and the structure for focusing may be a reflector or a lens or combination thereof. The second structure may be a resilient mounting for either the light bulb, filament, reflector or lens or combinations thereof.

2 Claims, 2 Drawing Sheets

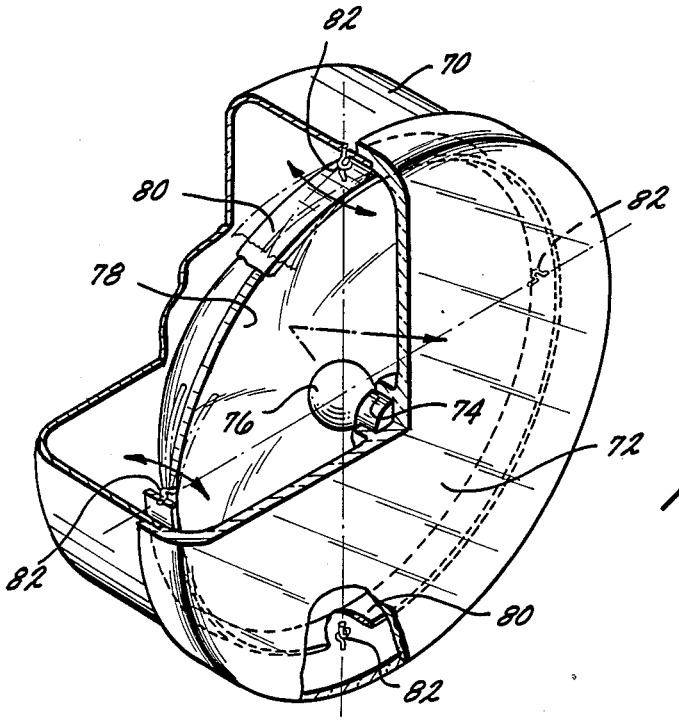
FIG. 3
FIG. 4
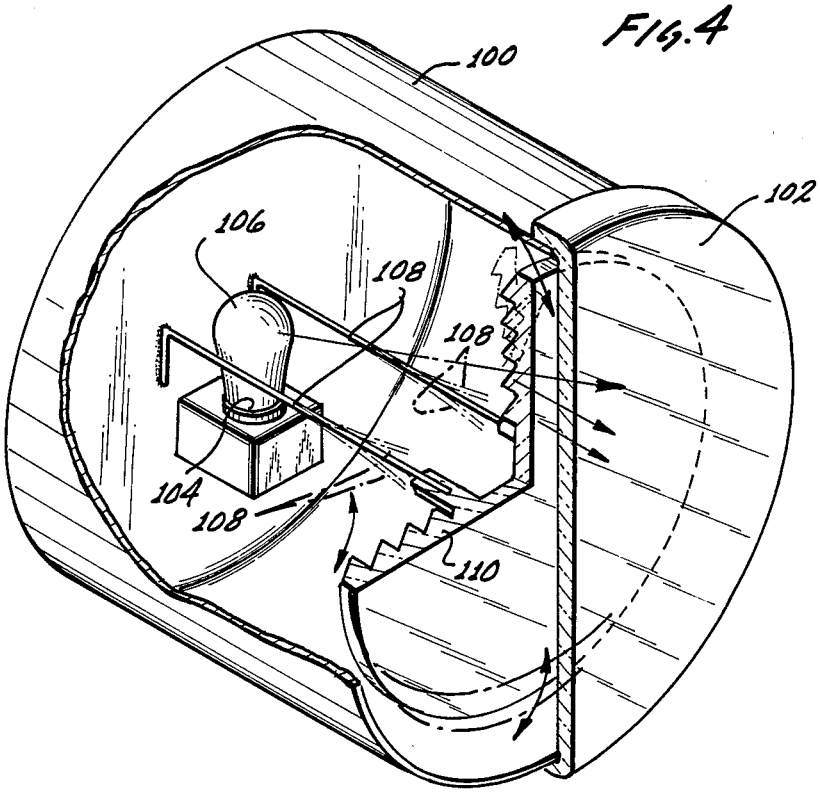

VEHICULAR LAMP WITH MOVING LIGHT SOURCE

BACKGROUND OF THE INVENTION

1. Field of the Invention

The present invention if directed to a vehicular lamp providing a moving light display and specifically the present invention is directed to the vehicular display signal or operating lamp providing the moving light display.

2. Description of the Prior Art

It is a well known axiom that movement attracts attention. For example, lamps that display and project moving light attract more attention than those that do not. Advertising displays traditionally use flickering or moving light displays so as to provide for the maximum attention. Even vehicle lamps also occasionally incorporate light movement when attention to the vehicle must be maximized. One specific example is the rotating lamps used by ambulances and police cars. Other moving lights have been used on vehicles when the light sources have been spring mounted to isolate them from vehicular motions that would damage them. In these applications the movement of the light source is held to a minimum and is not coordinated with reflectors or lenses to emphasize the movement.

SUMMARY OF THE INVENTION

The lamps currently used with various types of vehicles, generally include means for controlling and intensifying the light energy produced by the lamp. For example, the control of light rays emitted from such lamps is commonly achieved with reflectors and/or lenses. Placing a source of light energy at the focal point of a properly designed reflector and/or lens directs the light rays from the lamp in a desired beam of such light energy. The intensity of the light emitted is thereby increased since the light energy is channeled in one direction.

The present invention provides for the light movement and variation in intensity of the light energy by any combination of a moving light source (filament or bulb), moving reflector or moving lens. As an example, if a light source moves toward a focal point, then through or near the focal point, and then away from the focal point, the light emitted from the lamp changes both direction and intensity with the movement of the light source. The same is true when the focal point moves towards, then through or near, and then away from a light source. This property of both light movement and variation in intensity will occur as long as the reflectors and lenses are designed with particular focal points.

The light movement and variation in intensity for the lamps of the present invention are achieved by attaching either the light source, reflector or lens to a resilient support. The resilient support will oscillate if a repetitive force equal or close to its natural frequency or multiple thereof, is applied to the support even if the repetitive force is very small. The resilient support will then oscillate at its natural frequency. Additionally, the resilient support may be constructed so that it has more than one natural frequency or mode of vibration so as to produce more than one pattern of motion of the light energy.

In one particular aspect of the present invention, the resilient support for the light source, reflector or lens has a natural frequency that will be excited by vehicular frequencies produced when the vehicle is in operation. The operation of the vehicle thereby causes the resilient support to oscillate in an undamped motion. In particular, the resilient support may have a natural frequency or frequencies, close or equal to the fundamental, subharmonic, or harmonic frequencies of any one of a number of repetitive forces or frequencies which normally occur when the vehicle is in operation. These may be as follows:

1. Suspension system frequencies: linear and rotational on all three mutually perpendicular axes.
2. Engine rotation.
3. Body vibration.
4. Wheel-roadway forces.

The present invention also provides for optimizing the light movement and variation in intensity of the vehicular lamp by matching the oscillations between the light source, reflector or lens so that the motion of the light energy is enhanced as much as possible. This may occur by having the light source pass through or near the focal point of the lamp so as to display and project moving light. Alternately, the reflector and/or lens may oscillate around the focal point to also display and project moving light to an observer of the vehicle.

One additional aspect of the invention is to ensure that the vehicular lamps of the present invention meet the various government motor vehicle safety standards. These standards include requirements for minimum and maximum luminous intensities. The lamps of the present invention are designed to function within the various governmental specified limits. The government standards also specify "steady burning" for some lamps and on/off cycling for others. Lamps of the present invention that are designed to meet the luminous intensities required may be used for both types of these government specified lamps. In addition, lamps of the present invention that are designed to have lower intensities than those specified in the government standards may be used in combination with other lamps and the combination therefore would meet the standards for multiple compartment lamps.

BRIEF DESCRIPTION OF THE DRAWINGS

A clearer understanding of the present invention will be had with reference to the following description and drawings wherein;

FIG. 3 is a perspective cut-away view of a third embodiment of the invention showing a lamp with a resiliently mounted reflector; and FIG. 4 is a perspective cut-away view of a fourth embodiment of the invention illustrating a lamp with a resiliently mounted lens.

It is to be appreciated that the variously described embodiments of the invention shown in FIGS. 1 through 4 all incorporate a single resiliently mounted element as part of the lamp structure but that various combinations of these resiliently mounted elements may be employed. Therefore, any combination of moving light source, moving reflector or moving lens may be used so as to amplify the light movement and variation in intensity of the displayed light energy.

Figure 1:
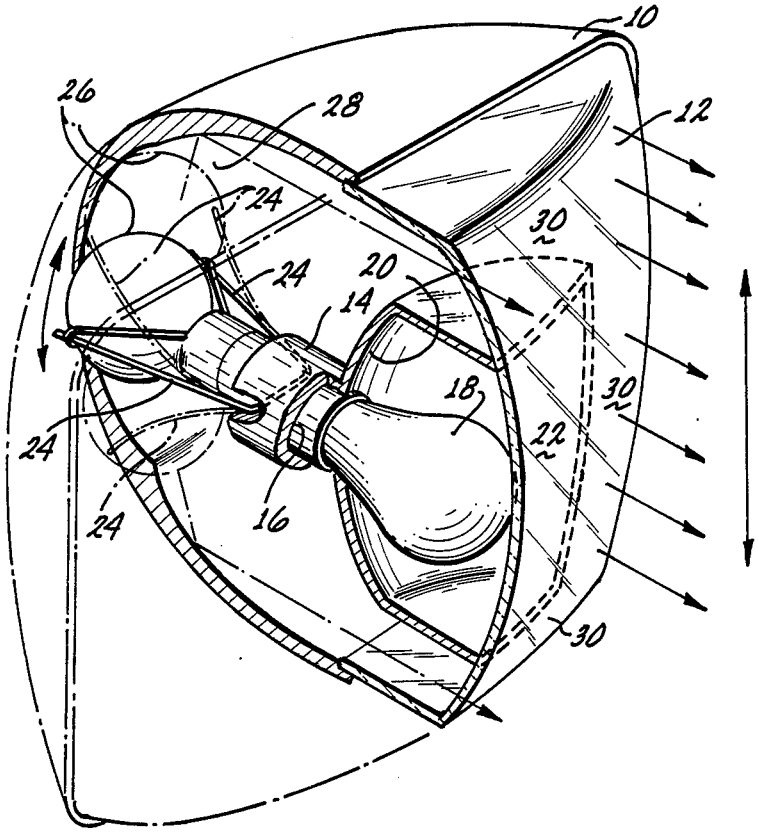
FIG. 1 is a perspective cut-away view of a first embodiment of the invention showing a two (2) compartment lamp including one (1) stationary and one (1) resiliently mounted light bulb.

FIG. 1 illustrates a first embodiment of the invention and as shown, is a two compartment lamp which may, for example, be used as a vehicle tail lamp. The embodiment of FIG. 1 has an outer body or housing 10 which includes a spherical lens 12 supported at its outer edges. A support structure 14 is located in the interior of the lamp and with the support structure including a well 16 designed to receive and support a light bulb 18. Extending from the support structure 16 is a first reflector surface 20 to channel light energy from the light bulb 18 towards a first area 22 of the lens 12. The light energy visible in the area 22 provides for a constant emission of light energy and may thereby provide for normal tail light functions as specified by government regulations. For example, the bulb 18 may be a 2 filament bulb and with the light energy visible in the area 22 providing for both a normal tail light and stop light. Alternatively, the bulb 18 may be controlled to provide for a turn signal. In either case, the light energy at the area 22 may meet with the necessary government regulations for vehicle tail lights.

Extending from the support structure 14 and toward the back of the housing 10 is a resilient flexible light support structure 24. A light bulb 26 is supported for illumination by the resilient support structure 24. As can be seen in FIG. 1, the light bulb can move up and down at the back of the housing 10. The back wall of the housing 10 is formed as a light reflector 28 and specifically may be formed as multiple parabolic reflectors. The flexing of the resilient support 24 produces different positions for the light bulb 26 to provide for the light energy moving through the focal points of the parabolic reflectors 28. This provides for both a movement in the light and a variation in intensity of the light projected outward by the parabolic reflector 28.

In particular, a display band 30 of varying light energy is formed around the area 22 of steady state light energy. The light energy at the side portions of the display band 30 will tend to move up and down while the light energy at the top and bottom portions of the display band 30 will alternate bright and dim in accordance with the position of the light bulb 26. This movement and variation in intensity is extremely attention getting to any person observing the vehicle and will call attention to the vehicle and therefore another driver who is not paying attention to traffic.

It is to be appreciated of course, that the appropriate electrical connections are made to the light bulbs 18 and 26 in the normal manner and it is also to be appreciated that either one or both of the light bulbs may be energized as desired. In order to maximize the movement of the light energy from the light bulb 26, the resilient support 24 may have a natural frequency that is similar to on of the frequencies that are normal to the vehicle. As an example, the resilient support 24 may provide for a two (2) cycle per second natural frequency to match the frequency for the wheel-roadway forces imposed on a truck.

Figure 2:
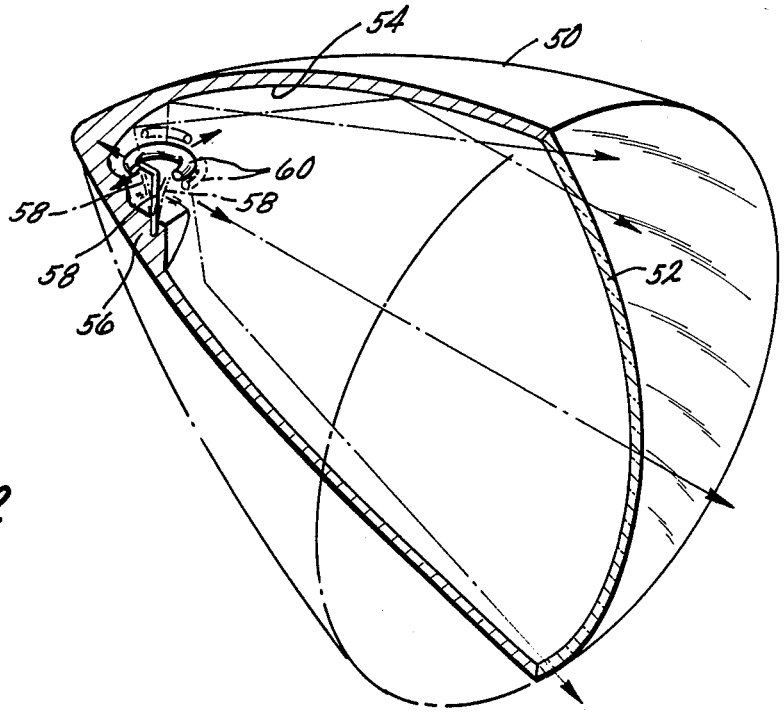
FIG. 2 is a perspective cut-away view of a second embodiment of the invention showing a sealed beam lamp with a resiliently mounted filament.

FIG. 2 illustrates a second embodiment of the invention and specifically shows a sealed lamp including a resiliently mounted filament. The lamp includes a body or housing 50 which supports a lens 52 at its outer surface. The interior surface of the body 50 forms a parabolic reflector 54. A support surface 56 is mounted at the rear of the lamp and with a resilient support 58 extending upward from the surface 56 to support a filiment 60.

As shown in FIG. 2, the resilient support 58 allows for complete forward/backward and side-to-side motion of the filament 60 so as to vary both the direction and orientation of the filament 60. This movement of the filament provides for the source of light to move through and around the focal point of the parabolic reflector 54. The movement of the filament in turn produces both light movement and variation in intensity of the light energy projected from the lens 52.

In order to enhance the movement of the filament 60, the natural frequency of the resilient support 58 for filament 60 is designed to be either close to or equal to one of the natural frequencies found in the vehicle. As an example, the lamp of FIG. 2 may have a natural frequency for the filament support of approximately twelve (12) cycles per second which is close to wheel-suspension frequencies commonly occurring in vehicles. Vehicular motion will therefore induce motion of the filament thereby enhancing the display of the movement of light of the lamp of FIG. 2.

The third embodiment of the invention is as shown in FIG. 3 and includes a housing 70 which supports an outer lens 72. The lens 72 includes a mounting area 74 to receive and support a light bulb 76. A parabolic reflector 78 is mounted within a gimbal ring 80 and with torsion springs 82 interconnecting the reflector 78 and the gimbel ring 80 at two (2) pivot points located oppositely across the reflector 78. The gimbal is connected to the housing with two torsion springs 82 on an axis 90° from (or at right angle to) the ring reflector attachment axis. This allows the reflector 78 to wobble in any direction when oscillating forces are transmitted from the vehicle to the lamp. The light bulb filament is located at the focal point of the reflector which is also where the gimbal exes intersect. The reflector therefore pivots around the filament pointing the light beam in the direction it happens to be momentarily facing. The wobbling light beam would point at and then away from an observer ensuring his attention. Again the natural frequency for the resilient mounting including the torsion springs should be matched to one of the natural frequencies within the vehicle.

The fourth embodiment of the invention is as shown in FIG. 4 and includes a housing 100 supporting an exterior lens 102. A light bulb support 104 is located at the back of the housing and supports a light bulb 106 to extend upwardly. A pair of lens spring supports 108 extend from the back of the housing 100 and supports a fresnel lens 110 immediately behind the exterior lens 102. The resilient spring supports 108 allow the fresnel lens 110 to rock up and down tilting as it does so, as shown in FIG. 4. The movement approximates an arc with its center at the filament of the bulb. Therefore the beam emitted from the lens will rock up and down pointing at and then away from an observer thereby ensuring his attention. As indicated above, it is desirable to match the natural frequency of the resilient support to that of a natural frequency within the vehicle to enhance the light movement and variation in light intensity. As an example, the natural frequency of the lens support may be designed to be approximately two (2) cycles per second.

Although the invention has been described with reference to various embodiments, which are designed to match particular natural frequencies, other frequencies may be used when they are close or equal to the fundamental, subharmonic, or harmonic frequencies of any of a number of repetitive forces or frequencies which occur within a vehicle. For example, these repetitive forces or frequencies occur from suspension systems, engine rotation, body vibration and wheel-roadway forces and any of those forces or any other repetitive forces which occur within the vehicle may be matched by the natural frequencies of the resilient mountings described in this application.

The lamps of the present invention include light sources which have relative movement between the light source and a focal point of reflectors and lenses so as to provide for the variation is light movement and in intensity. This may be provided by individual or combinations of moving light sources, moving reflectors or moving lenses. Additionally, the moving light source may either be a movement of the whole light bulb or a movement of a filament within the light bulb. All of these structures will accomplish the object of the present invention and the invention is therefore only to be limited by the appended claims.

I claim:

1. A vehicle lamp for mounting on a vehicle and providing a moving and variable light intensity display, including, a lamp body including a display area for visually displaying light energy provided within the lamp body, a source of light energy located with the lamp body, means operatively coupled to the source of light and supported by the lamp body for directing the light energy produced by light source at and thru the display area, means operatively coupled to the source of light and the directing means for providing relative movement between the source of light and the directing means for producing variations in the direction of the light energy at the display area to provide a moving and variable light intensity at and thru the display area, the means for providing relative movement including a resilient mounting responsive to natural forces produced when the vehicle is operated, the resilient mounting having a natural frequency within a visibly observable range and approximating the fundamental, subharmonic, or harmonic frequencies of at least one of the natural forces produced when the vehicle is operated to provide oscillation of the resilient mounting at its natural frequency when the vehicle is operated and thereby provide an enhancement of the movement and variable intensity of the light display, and wherein the source of light is a filament and the means for providing relative movement is a resilient mounting for the filament to provide for movement of the filament in response to natural forces produces when vehicle is operated.

2. A lamp for use on a moving object for providing a variable light display, including, a lamp housing including a display area for visually displaying light energy, a source of light energy located within the lamp housing for producing visual light at the display area, directing means located within the lamp housing and operatively coupled to the source of light energy for enhancing the visual light at the display area by directing the light energy to and thru the display area, resilient means located within the housing and having a natural frequency responsive to forces produced by the moving object for providing relative movement between the source of light energy and the directing means for varying the direction of the light energy to and thru the display area to produce the variable light display, the resilient means having a natural frequency discernible within a visibly observable range and approximating the fundamental, subharmonic, or harmonic frequencies of at least one of the forces produced by the moving object to provide oscillation of the resilient means, at the natural frequency and thereby enhance the variable light display, and wherein the source of light is filament and the resilient means forms a resilient mounting for the filament to provide for movement of the filament.

* * * * *